United States Patent [19]

Maruko

[11] Patent Number: 4,613,852

[45] Date of Patent: Sep. 23, 1986

[54] DISPLAY APPARATUS

[75] Inventor: Kinya Maruko, Oume, Japan

[73] Assignee: Tokyo Shibaura Denki Kabushiki Kaisha, Kawasaki, Japan

[21] Appl. No.: 546,041

[22] Filed: Oct. 27, 1983

[30] Foreign Application Priority Data

Oct. 29, 1982 [JP] Japan ..... 57-190309

[51] Int. Cl.[4] ..... G09G 1/14

[52] U.S. Cl. ..... 340/703; 340/723; 340/747; 340/799

[58] Field of Search ..... 340/703, 723, 747, 798, 340/799

[56] References Cited

U.S. PATENT DOCUMENTS

| | | | |
|---|---|---|---|
| 4,149,184 | 4/1979 | Giddings et al. | 340/703 |
| 4,183,046 | 1/1980 | Dalke et al. | 340/703 |
| 4,303,986 | 12/1981 | Lans | 340/703 |
| 4,509,043 | 4/1985 | Mossaides | 340/703 |

OTHER PUBLICATIONS

O'Brien et al., "Videotex Presentation Level Procotol: Augmented Picture Description Instructions" (Feb. 1982).

PD7220 GDC User's Manual; Nippon Electric Co., Ltd. (Mar. 1982).

*Primary Examiner*—Gerald L. Brigance

*Attorney, Agent, or Firm*—Schwartz, Jeffery, Schwaab, Mack, Blumenthal & Evans

[57] ABSTRACT

In a display apparatus comprising a plurality of memory planes, and a graphic display controller for writing data in and reading data from the memory planes, a logical operation circuit capable of performing logical operation in a plurality of different modes of operation is provided and is controlled to perform, in the mode latched in a mode registration circuit, logical operation on the data read from the memory planes. A selector selectively outputs data from one of the memory planes or data from the logical operation circuit.

5 Claims, 4 Drawing Figures

DISPLAY APPARATUS

BACKGROUND OF THE INVENTION

This invention relates to an improvement of a display apparatus.

With the increase in capacity and decrease in costs of IC memories in recent years, raster scanning color graphic display systems having a large capacity bit map memory plane are becoming more compact and less expensive. Such a color graphic display comprises three bit map memory planes respectively corresponding to three primary colors, i.e., red, green and blue, a function generator and a microprocessor. When displaying a graphic pattern in the graphic color display system, the function generator is made to generate display information, which is successively developed into the respective memory planes and is then cyclically read in synchronism with the raster scanning, and is transferred to a CRT monitor to result in the desired display.

During the display, logical or arithmetic operations are frequently conducted on the contents read out of the memory locations of the memory planes of the same or corresponding picture elements.

For instance, in a color display apparatus, there may be provided three memory planes for storing data of the three primary colors, and it may be desired to form an image pattern consisting of the area on which two or more colors are superimposed or mixed, or to select the area of a single specific color. In such cases, it is necessary to perform logical operations on the data from the memory planes.

To meet the need of logical operations, a conventional picture display apparatus generally employs a high-speed microprocessor which sequentially reads the data from the memory planes and performs logical operations on the data read out.

Such an arrangement is satisfactory small capacity memory planes. But with memory planes of a large capacity, e.g., 1024×1024 dots, it takes a long time for the microprocessor to read the data from the memory planes and to conduct the logical operations on the data read out, so that the performance of the overall device is limited.

SUMMARY OF THE INVENTION

An object of the invention is to provide a display apparatus with which it is possible to reduce the burden on the microprocessor when logical operations are performed on the data read out of the memory planes, thereby raising the processing speed.

According to the invention, there is provided display apparatus comprising:

a plurality of memory planes for storing data for display, graphic display control means for writing data in and reading data out from the memory planes, a data processing unit for controlling the memory planes and the graphic display control means, a system bus for connecting the data processing unit and the graphic display control means, a display bus for connecting the graphic display control means and the memory planes, a logical operation circuit capable of performing logical operation in a plurality of different modes of operation, mode registration means for latching a mode of operation designated by the data processing unit, an instruction for the designation being supplied through the system bus, the logical operation circuit being controlled to perform, in the mode latched in the mode registration means, logical operation on the data read from the memory planes, and a selector receiving data read from the memory planes and data outputted from the logical operation circuit, and making selection in accordance with designation from the data processing unit, and outputting the selected data to the display bus.

DETAILED DESCRIPTION OF THE PREFERRED EMBODIMENTS

Figure 1:
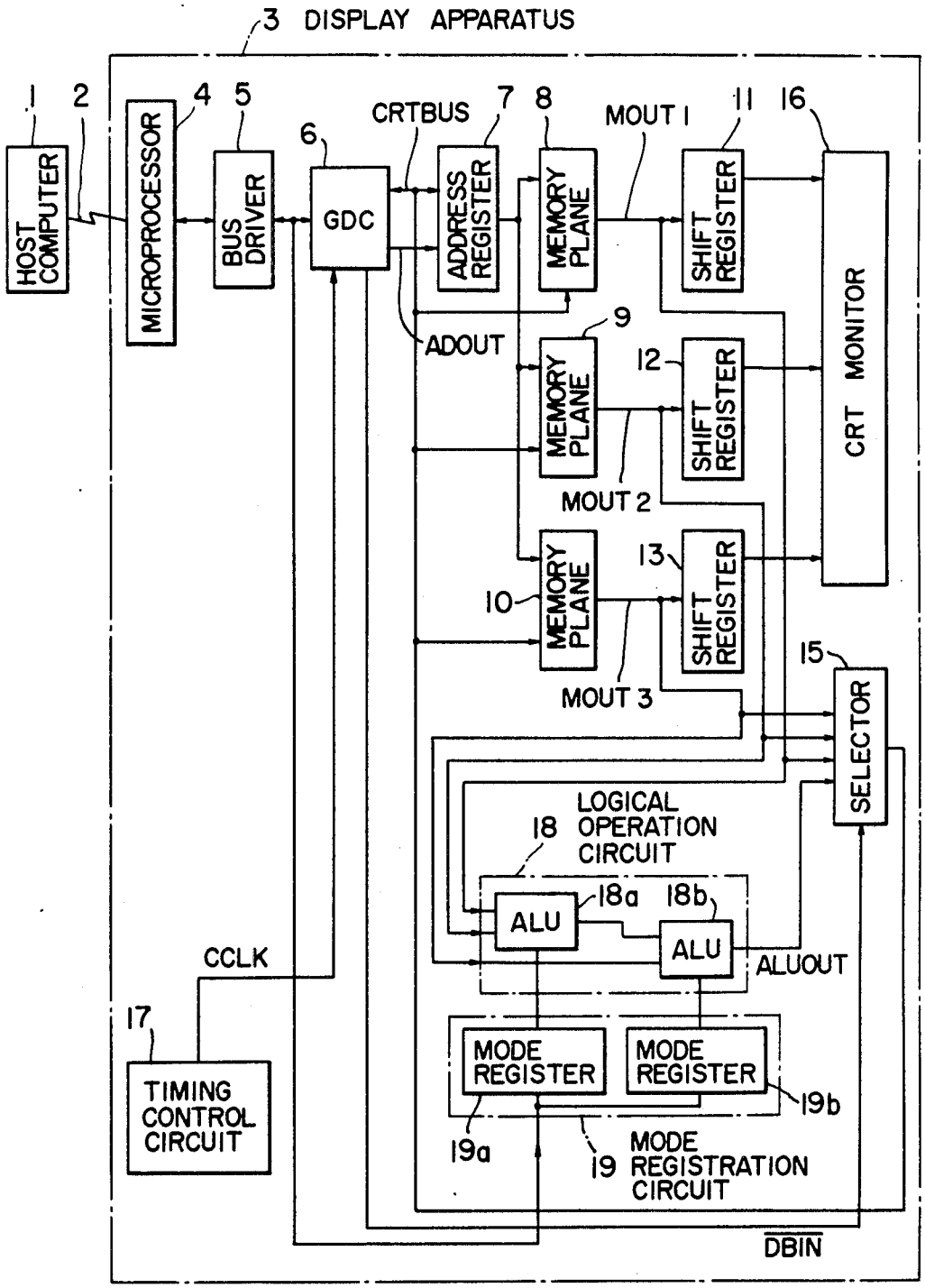
FIG. 1 is a block diagram showing part of the display apparatus according to the invention.

FIG. 1 shows an essential part of a display apparatus 3 of an embodiment of the invention. The display apparatus 3 is connected to a host computer 1 via a communication cable 2.

The display apparatus 3 comprises, as is conventional, a data processing unit such as a microprocessor 4 connected to the communication cable 2 and controlling the rest of the display apparatus 3, a bidirectional bus driver (system bus) 5 connected to the microprocessor 4, a graphic display controller (hereinafter referred to as GDC) 6 connected to the bus driver 5, and three memory planes 8, 9, 10 connected to the GDC via an address register 7 and a CRT bus (display bus). The memory planes 8, 9, 10 store data of three primary colors, i.e., red, blue and green, on a bit-by-bit basis. The address register 7 stores an address of the locations in the memory planes to be accessed. The GDC 6 writes data in and reads data out from the memory planes thereby controlling drawing of data and display of data by a CRT (cathode ray tube) monitor 16. The data outputted from each of the memory planes 8, 9, 10 is in the form of 1 byte (8 bits) of parallel data indicative of the level "1" or "0" of each of 8 dots adjacent to each other and aligned in a horizontal direction. Shift-registers 11, 12, 13 are connected to the memory planes 8, 9, 10, respectively, and perform parallel-to-serial conversion to convert the parallel data from the memory planes 8, 9, 10 to serial data. The outputs of the shift registers 11, 12, 13 are supplied to the CRT monitor 16 for display on its display screen. The display apparatus 3 further comprises a timing control circuit 17 generating timing signals used for control of the various components of the display apparatus. The timing signals include a clock signal CCLK comprising elementary clocks $\phi_1$, $\phi_2$, $\phi_3$.

The microprocessor 4 transfers display information via the bidirectional bus driver 5 and also sets parameters in the GDC 6 to define the screen arrangement. The GDC 6 conducts movement in accordance with the parameter data, writes picture element information in the memory planes 8, 9, 10 corresponding to the primary colors, and performs reading operations for the purpose of display in cooperation with various timing signals outputted from the timing control circuit 17.

Address designation during the read/write operation is accomplished by setting an address value in the address register 7. An example of a device used for the GDC 6 is a graphic display controller with a model number μPD 7220 supplied by Nippon Electric Co., Ltd., Japan.

Moreover, according to the invention, the display apparatus 3 further comprises a logical operation circuit 18 capable of performing logical operation in a plurality of different modes of operation, and a mode registration circuit 19 for latching data or instructions indicative of a mode of operation designated by the microprocessor 4. The instruction for the designation of the mode is supplied through the bus driver 5. The logical operation circuit 18 is controlled to perform, in the mode latched in the mode registration circuit 19, logical operation on the data read out of the memory planes 8, 9, 10.

In the illustrated embodiment, the logical operation circuit comprises a first ALU (arithmetic-logic unit) 18*a* receiving data read from two of the three memory planes, e.g., the plane memories 8, 9 and performing operation on the data received, and a second ALU 18*b* receiving data read from the remaining memory plane 10 and data outputted from the first ALU 18*a*, and performing operation on the data received. Each of the first and the second ALU 18*a*, 18*b* is capable of performing operations in a plurality of different modes, including logical AND operation mode, logical OR operation mode and logical Exclusive-OR operation mode. An example of device used as the ALU 18*a*, 18*b* is a model SN74181 supplied by Texas Instruments Incorporated, U.S.A.

The mode registration circuit 19 comprises first and second mode registers 19*a*, 19*b* respectively latching data indicative of the mode in which the respective ALU 18*a*, 18*b* are required to perform operation. In addition, a selector 15 is provided to receive data read out of the memory planes 8, 9, 10 and data outputted from the logical operation circuit 18. The selector 15 makes selection in accordance with a control signal from the microprocessor 4, and outputs the selected data to the CRT bus. Supplied to a select input terminal of the selector 15 is a signal $\overline{\text{DBIN}}$ (data bus in signal) outputted from the GDC 6. This signal $\overline{\text{DBIN}}$ is outputted when the GDC 6 performs READ/MODIFY/-WRITE operations on memory planes 8, 9, and 10 and is used as a permission signal for permitting outputs of the memory planes 8, 9, and 10 or ALU 18*b* to be written into the memory planes 8, 9, and 10. More detailed description of the GDC 6 can be obtained from a literature "μPD 7220 GDC user's manual" published by Nippon Electric Co., Ltd. The data outputted by the selector 15 are supplied to the address register 7 and the memory planes 8, 9, 10.

Figure 2:
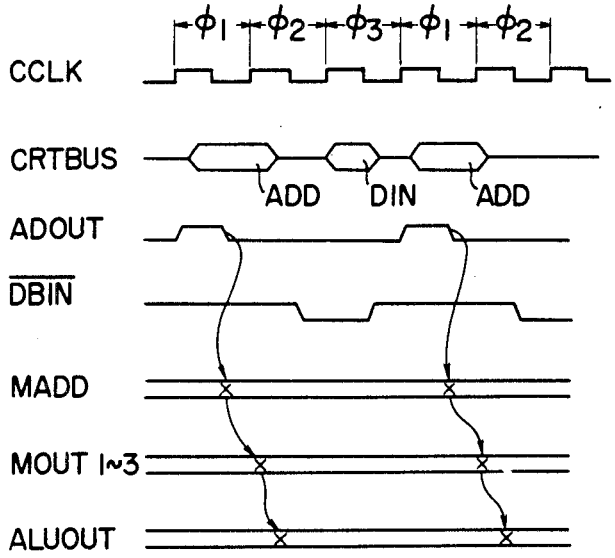
FIG. 2 is a time chart showing the operation of the display apparatus.

The operation of the display apparatus will now be described with reference to FIGS. 2, 3 and 4.

First, the host computer 1 gives an instruction to the display apparatus 3 through the communication cable 2. The contents of the instruction are decoded by the microprocessor 4. Assume that the instruction decoded signifies that pattern data in white in an area of X =0–7, Y=0–9-, i.e., 10 bytes from X=0, Y=0, FIG. 3, should be extracted and displayed.

A white pattern is formed when the data of red, blue and green are all "1" (high level). The microprocessor 4 therefore conducts common data setting in the mode registers 19*a*, 19*b* so that the ALU 18*a*, 18*b* operate in the AND operation mode. The logical operation circuit 18 is thereby prepared to conduct a logical AND operation on data from the three memory planes. The data outputted by the logical operation circuit 18 will be a logical product of the data from the three memory planes.

Next, the microprocessor 4 outputs a command to set the selector 15 to supply the output of the logical operation circuit 18 to the CRT bus and a command to make the GDC 16 read the data over the length of 10 bytes in the vertical direction from the location X=0, Y=0. The GDC 16 can therefore read the result of logical operation on the data from the memory planes at the timing shown in FIG. 2.

More detailed description on the reading operation is given below with reference to FIG. 2.

First, at the timing of an elementary clock $\phi_1$, address information is placed by the GDC 6 on the CRT bus. The address information is set in the address register 7 at the trailing edge of a signal (AD OUT) outputted by the GDC 6. The address information (ADD) set in the address register 7 is supplied as address register output signal MADD to the memory planes 8, 9, 10, which output the contents of the accessed locations designated by the common address information, i.e., the contents of the locations of the same address. The outputted data are supplied as signals MOUT1, MOUT2, MOUT3 to the logical operation circuit 18. The ALU 18*a*, 18*b* of the logical operation circuit 18 are already set to perform AND operation, so that AND operation is executed on MOUT1, MOUT2, MOUT3. The result of the operation is outputted as ALU OUT signal and is supplied to the selector 15.

Next, the GDC 6 renders "low" level the signal $\overline{\text{DBIN}}$ at the trailing edge of the elementary clock $\phi_2$. This signal $\overline{\text{DBIN}}$ is for placing the ALU OUT signal inputted to the selector 15 on the CRT bus. While this signal $\overline{\text{DBIN}}$ is at "low" level, the output signal of the selector 15 is transferred through the CRT bus. The data on the CRT bus is inputted to the GDC 6 at the elementary clock $\phi_3$ as input data DIN. Reading operation on one byte is thus completed. Such reading operation is successively conducted for all the 10 bytes in the area Y=0–9 (with X=0 -7). The order of the reading operation is from the first time (Y=0) to the tenth line (Y=9).

The data DIN inputted to the GDC 6 consists solely of the data of white dots. The contents of the plane memories 8, 9, 10 are rewritten so that only the signals (bits) of the addresses having a white dot are left at "high" level. The rewritten contents of the memories can be parallel-serial converted by the shift registers 11, 12, 13 and displayed on the screen as is in FIG. 4.

Figure 3:
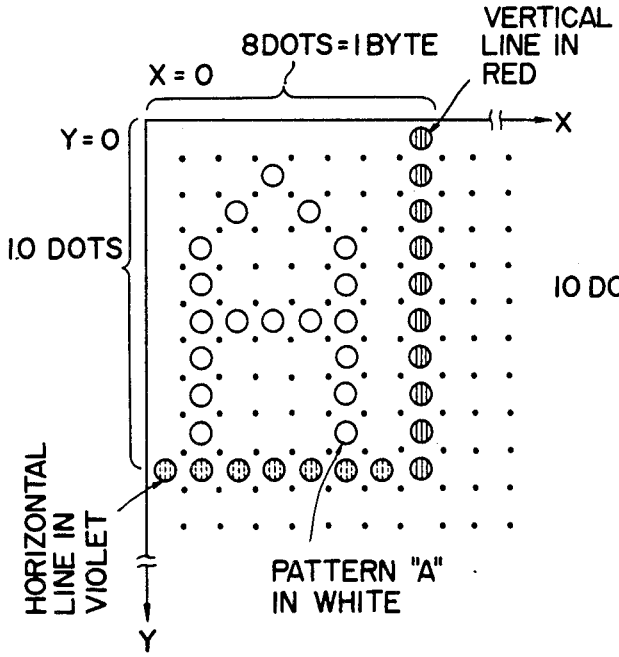
FIGS. 3 and 4 are diagrams showing how the pattern of white is extracted by the display apparatus.
Figure 4:
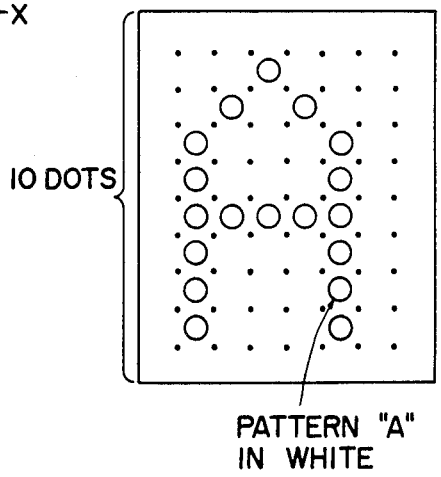

By the process described, the dots having a color other than white are "disregarded" by the logical operation circuit, so that the red vertical line and violet horizontal line present in FIG. 3 are suppressed and only the character "A" in white is displayed on the screen of the CRT monitor 16.

Thus, in the operation mode described above, the logical operation circuit 18 is conditioned to take the logical AND of the three inputs to extract the white portion of the image. When other operation mode is selected, other logical operations are performed to extract or suppress other color.

In the embodiment described above, the number of the memory planes is three. But the invention is applicable where the number of the memory planes is other than three. The logical operation circuit 18 may be modified according to the number of the plane memories. For example, the number of the ALU (18*a*, 18*b*) and the interconnection of them may be modified according to the number of the memory planes.

The embodiment described above is one for extracting or suppressing a specific color in a color display apparatus. The invention is however applicable to a monochromatic display apparatus where data of image portions of a plurality of different brightness levels are stored in different plane memories and the portions of one or more selected brightness levels are extracted or suppressed; or where data of image portions of a plurality of different modes of illumination, e.g., continuous illumination and blinking, are stored in different plane memories and the portion of the selected illumination mode is extracted or suppressed.

As has been described, according to the invention, logical operations on the outputs of the plane memories are conducted by a logical operation circuit which simultaneously receives the outputs of the memory planes. As a result, the microprocessor which controls the entire display apparatus need not perform the logical operations. Besides, the readings of data from the memory planes are conducted simultaneously. The processing speed for the display is therefore significantly increased.

What is claimed is:

1. Display apparatus comprising:

a plurality of memory planes for storing data for display, graphic display control means for writing data in and reading data out from the memory planes, a data processing unit for controlling the memory planes and the graphic display control means, a system bus for connecting the data processing unit and the graphic display control means, a display bus for connecting the graphic display control means and the memory planes, mode registration means for latching a plurality of different modes of operation, said modes being designated by the data processing unit, wherein an instruction for the designation is supplied through the system bus, a logical operation circuit capable of performing a plurality of different logical operations, each mode of operation being associated with one of said plurality of different logical operations, wherein the logical operation circuit performs one of said logical operations on the data read from the memory planes in accordance with the mode latched in the mode registration means, and means for receiving data outputted from the logical operation circuit, and supplying said received data to the display bus in accordance with a control signal from said data processing unit.

2. Apparatus as set forth in claim 1, wherein the data outputted from said logical operation circuit to said display bus is supplied to and stored in at least one of the memory planes.

3. Apparatus as set forth in claim 1, wherein the memory planes comprise three memory planes for storing data of three primary colors.

4. Apparatus as set forth in claim 3, wherein the logical operation circuit comprises:

a first arithmetic-logic unit receiving data read from two of the three memory planes, and performing a logical operation on the data received, and a second arithmetic-logic unit receiving data read from the remaining memory plane and data outputted from the first arithmetic-logical unit, and performing a logical operation on the data received, wherein each of the first and second arithmetic-logic units are capable of performing a plurality of operations in a plurality of different respective modes, and wherein the mode registration means latches a mode for each of the first and the second arithmetic-logic units.

5. Apparatus as set forth in claim 1, wherein said graphic display control means transfer control signals from the data processing unit to the receiving means.

* * * * *